United States Patent [19]

Kagerhuber et al.

[11] 4,150,715

[45] Apr. 24, 1979

[54] SUPPORTING AND GUIDING MEANS FOR CAST STRANDS

[75] Inventors: Franz Kagerhuber, Traun; Werner Scheurecker, Linz, both of Austria

[73] Assignee: Vereinigte Österreichische Eisen- und Stahlwerke - Alpine Montan Aktiengesellschaft, Linz, Austria

[21] Appl. No.: 826,944

[22] Filed: Aug. 22, 1977

[30] Foreign Application Priority Data

Sep. 9, 1976 [AT] Austria ..... 6679/76

[51] Int. Cl.[2] ..... B22D 11/12

[52] U.S. Cl. ..... 164/448

[58] Field of Search ..... 164/425, 426, 447, 448, 164/441, 442, 438, 427, 82

[56] References Cited

U.S. PATENT DOCUMENTS

| | | | |
|---|---|---|---|
| 3,338,297 | 8/1967 | Foldessy | 164/426 |
| 3,911,995 | 10/1975 | Yu | 164/426 X |
| 4,018,261 | 4/1977 | Scheinecker | 164/448 |
| 4,022,369 | 5/1977 | Wunnenberg | 164/448 |

*Primary Examiner*—Roy Lake
*Assistant Examiner*—John S. Brown
*Attorney, Agent, or Firm*—Brumbaugh, Graves, Donohue & Raymond

[57] ABSTRACT

In a supporting and guiding means for continuously cast strands including a plurality of exchangeable supporting elements each provided with rollers at opposite sides thereof, neighboring supporting elements are provided with shoulder-like projections where they are separated from each other. The projections are oppositely arranged, back each other, and carry one roller each so as to complement each other to form a pair of oppositely arranged rollers.

4 Claims, 3 Drawing Figures

SUPPORTING AND GUIDING MEANS FOR CAST STRANDS

BACKGROUND OF THE INVENTION

This invention relates to a supporting and guiding means for cast strands, in particular cast slabs, in a continuous casting plant having a number of exchangeable supporting elements, which supporting elements are provided with rollers at opposite sides thereof.

The strand emerging from the mould and having a strand skin of only very slight thickness must be supported and guided over a great length. The supporting and guiding means provided therefor has a correspondingly great longitudinal extension and is sub-divided into a number of individually removable and exchangeable supporting elements because of its great own weight and the manipulation difficulties resulting therefrom.

From German Pat. No. 1,285,095, e.g., it is known to divide the supporting and guiding means perpendicular to the axis of the strand path to form supporting elements that can be handled more easily. The supporting elements arranged one behind the other in the longitudinal direction of the strand must be carefully aligned relative to one another for obtaining a satisfying quality of the strand, especially in bow-type continuous casting plants. It is particularly detrimental to the quality of the strand if neighbouring supporting elements are offset relative to each other and thus the roller path is no longer continuous, but has discontinuities. Beside a quality impairment, these discontinuities can cause a great increase in the extraction forces and pronounced deformations of the strand skin, whereby even cracks can form in the strand skin.

For carrying out repairs, the damaged supporting element usually is not repaired at its place of installation, but is removed from the plant, transported to a repair stand and replaced by an intact supporting element that has already been adjusted to the strand thickness desired. In this manner, the facility downtime is kept as short as possible. It has been shown, however, that position control as well as the precise alignment of the newly inserted supporting element relative to the strand guide path formed by the remaining supporting elements, is very difficult. Thereby most of the time gained by the exchange-repair method is lost again.

Furthermore it is necessary to check the position of the supporting elements within short intervals, at the beginning of each shift for instance, in order to detect any damage before the quality of the strand is adversely affected. Hitherto this has not been possible because of the great amount of time needed for such a check-up.

SUMMARY OF THE INVENTION

The invention aims at avoiding these disadvantages and difficulties and has as its object to provide a supporting and guiding means of the above-defined kind, in which an exact measuring and a precise adjustment of the individual supporting elements relative to each other is possible in a simple and time-saving manner and with easy means. As a result a repair of the casting plant by exchanging a supporting element requires only short facility downtimes and a continuous checking of the position of the supporting elements is possible.

According to the invention, this object is achieved in that neighbouring supporting elements, at their place of separation, are provided with oppositely arranged shoulder-like projections backing each other. On each of the projections a roller is mounted, rollers which complement each other so as to form a pair of oppositely arranged rollers. By the formation of such a "complementary" roller pair, whose rollers belong to neighbouring supporting elements, only the distance between these roller pairs need be re-measured, e.g. by means of a rod-like micrometer, for checking the position of the supporting elements. If a check-up after a longer operation shows that the distance between the rollers of these roller pairs no longer corresponds to the desired distance, the cause therefor can either be that the diameter of these rollers no longer corresponds to the pre-determined diameter or that one of the supporting elements has been overly worn, e.g. by extracting a cooled-off strand, and thus has been deformed. In the latter case the damaged supporting element has to be exchanged. If after the exchange of a supporting element there is an undue deviation from the desired distance between the pairs of rollers common to the neighbouring supporting elements, the position of the newly inserted supporting element is to be changed until the distance between these pairs of rollers corresponds to the desired distance. The periodical checking of the distance between the pairs of rollers common to the neighbouring supporting elements makes it possible to find damage to the plant even before the quality of the strand is impaired.

For bow-type continuous casting plants, suitably one shoulder-like projection carrying a roller is provided on a bending element and the other projection carrying the counter-roller is provided on a circular-arc-shaped supporting element.

Advantageously there is further provided a shoulder-like projection carrying a roller on a circular-arc-shaped supporting element and the other projection carrying the counter-roller is provided on a straightening element.

If in a bow-type continuous casting plant, a driving roller element is interposed between a circular-arc-shaped supporting element and a straightening element, suitably a shoulder-like projection carrying a roller is provided on the circular-arc-shaped supporting element and on the driving element and the other projection carrying the counter-roller is provided on the driving element as well as on the straightening element.

According to a preferred embodiment, in which the bending element can be pivoted out for introducing a starter bar into the supporting and guiding means, the shoulder-like projection is provided on the arc-outer, pivoted-out end of the bending element.

Furthermore, the straightening element suitably is installable and removable in an approximately vertical direction, wherein at one or at both of its ends, shoulder-like projections are provided at the upper side of the straightening element.

BRIEF DESCRIPTION OF THE DRAWINGS

The invention shall now be described by way of two embodiments for bow-type continuous casting plants for continuously cast slabs and with reference to the accompanying drawings, wherein.

DESCRIPTION OF PREFERRED EMBODIMENT

Figure 1:
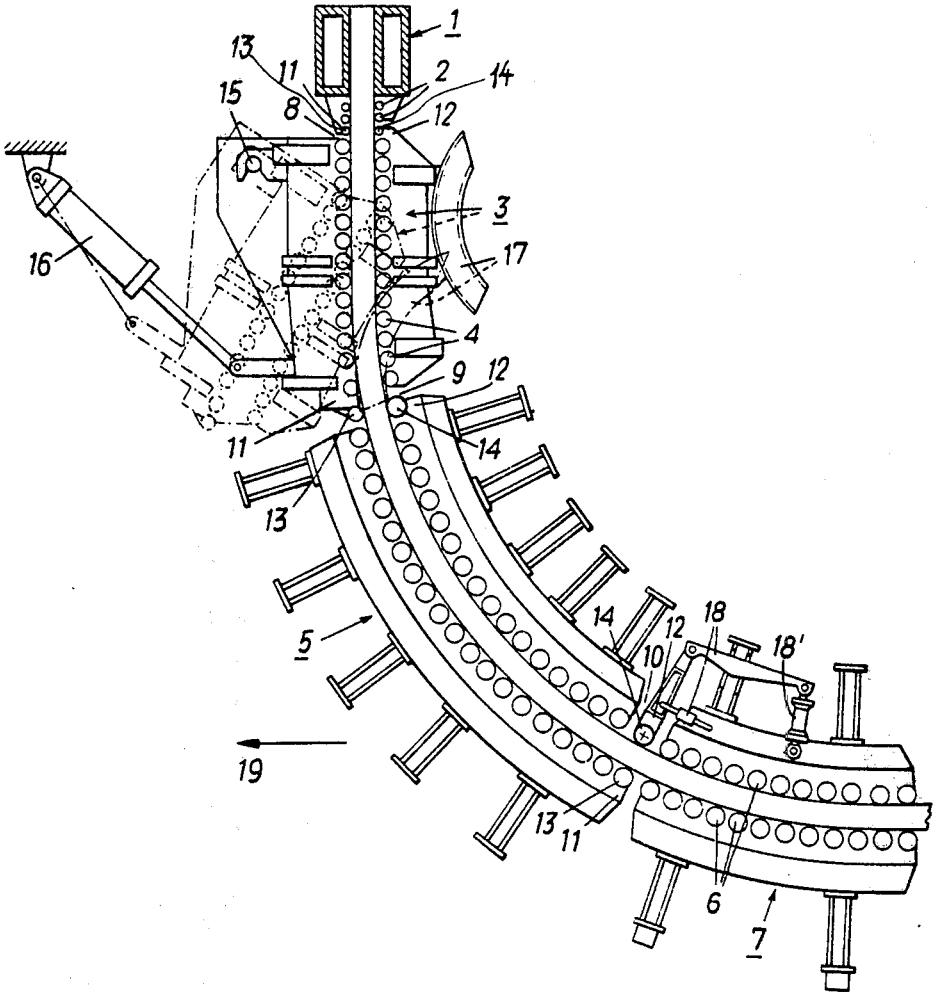
FIG. 1 is a schematically illustrated overall view of a supporting and guiding means according to one embodiment.

An arcuate strand guide supporting the strand at its broad sides by means of rollers, which guide in its entirety is referred to as a supporting and guiding means, is arranged to follow a mould denoted by 1.

At first, the cast strand emerging from the mould 1 is supported by foot rollers 2 secured to the mould. The supporting and guiding means following the foot rollers is, down to the horizontal strand guiding part, divided into three exchangeable parts according to FIG. 1, i.e. the supporting element 3 (bending element) containing the bending rollers 4, and a circular-arc-shaped supporting element 5 which is followed by a supporting element 7 (straightening element) provided with straightening rollers 6.

According to the invention, the neighbouring supporting elements are provided with shoulder-like projections (11, 12) at the places of separation (8, 9 and 10), of the supporting and guiding means, which shoulder-like projections back each other. On these projections one roller 13 and 14, respectively, is mounted. These rollers 13 and 14 mounted at the projections 11 and 12 thus form "complementary" roller pairs, supporting both sides of the strand at one place along its longitudinal extension. The places of separation (8, 9 and 10), according to the embodiment illustrated in FIG. 1, are arranged between the foot roller supporting means of the mould 1 and the bending element 3, between the bending element 3 and the circular-arc-shaped supporting element 5, and between the latter and the straightening element 7 following thereupon.

The bending element 3 is mounted to be pivotable about a stationary bolt 15 arranged at the outer side of the arc by means of a pressure medium cylinder 16 for introducing a starter bar into the supporting and guiding means. In the pivoted-out position illustrated in broken lines in FIG. 1, the starter bar can be introduced along the runners 17. In order to keep the distance between the rollers arranged at the ends of the bending element and on the circular-arc-shaped supporting element as small as possible, the shoulder-like projection 11 of the bending element is arranged at the place of separation 9 at the arc-outer side. The straightening element is provided with the shoulder-like projection 12 at the upper or arc-inner side, and thus it can be lifted out of the plant perpendicularly upwards without necessitating the removal of another supporting element. The shoulder-like projection 12 of the straightening element 7 is hinged to the straightening element 7 via guide-rods 18 and is perpendicularly movable relative to the surface of the strand by means of a pressure medium cylinder 18', whereby a driven roller 14 can be pressed onto the strand. A stop, not illustrated, assures that the roller 14 cannot be moved away from the surface of the strand beyond the extent of the desired strand thickness. The shoulder-like projection 12 of the straightening element 7 can also be rigid, approximately like the projection 11 of the bending means 3.

Suitably, after the pivoting out of the bending element 3, the circular-arc-shaped supporting element 5 is horizontally moved out of the plant in the direction of the arrow 19, e.g. by means of a car. The bending element 3 is perpendicularly upwardly removed.

For adjusting the position of the supporting elements 3, 5 and 7 relative to one another, common supports which are adjustable in height and in the horizontal direction, and which are not illustrated, are provided.

The horizontal strand guide may be of traditional construction, since a displacement of the supporting elements arranged in the horizontal direction relative to one another can easily be measured by a ruler.

Figure 2:
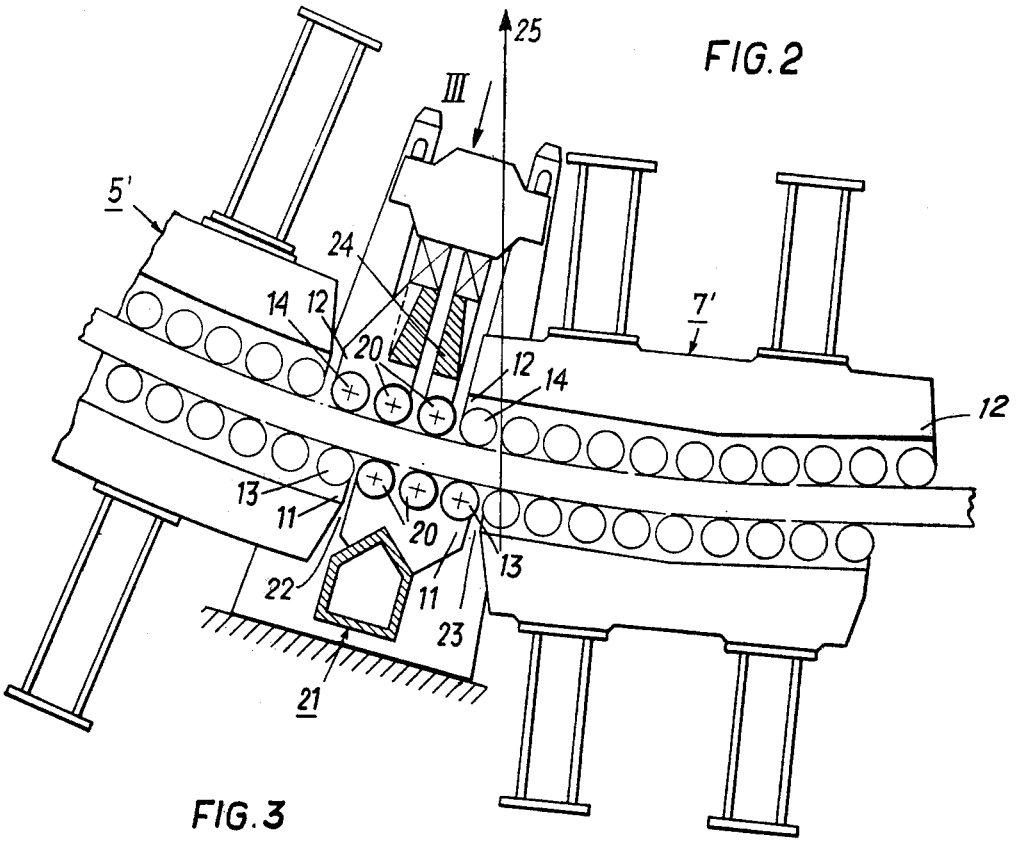
FIG. 2 shows, in an illustration like FIG. 1, a detail of a supporting and guiding means according to another embodiment.
Figure 3:
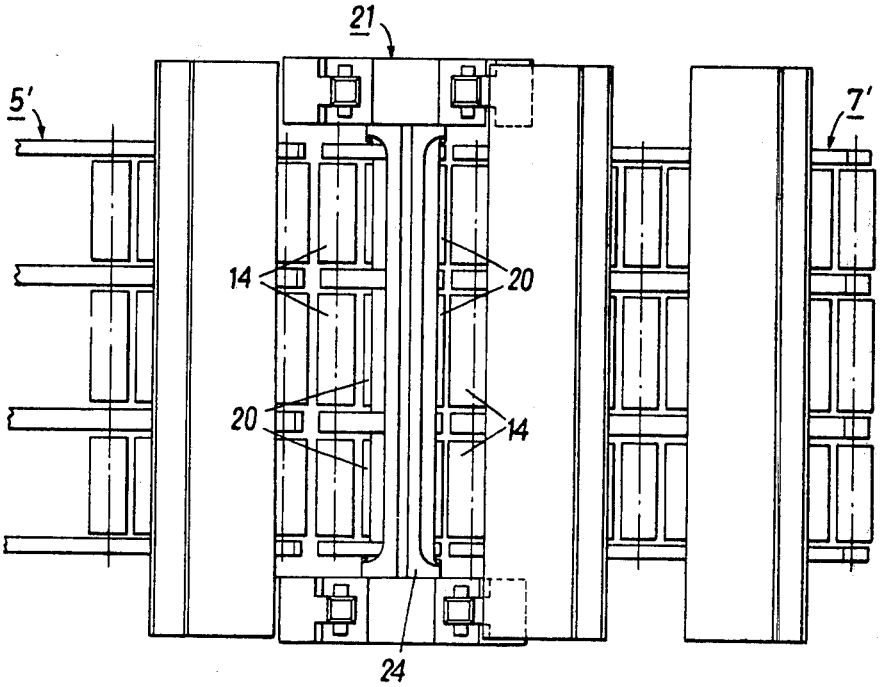
FIG. 3 is a view in the direction of the arrow III of FIG. 2.

In the embodiment illustrated in FIGS. 2 and 3, a driving roller 20 is contained in a supporting element (driving element) 21 provided between the circular-arc-shaped supporting element 5' and the straightening element 7'. At the places of separation 22 and 23 at both sides of the driving element 21, according to the invention there are provided shoulder-like projections 11 and 12. The shoulder-like projections 12 that belong to the straightening element 7' are arranged at the upper or arc-inner side, to permit the upward removal of the straightening element 7'. A transverse carrier 24 supporting the driving roller 20 is slanted at its side facing the straightening element in order to allow for an unhampered removal of the straightening element 7' in the direction of the arrow 25.

What we claim is:

1. In a supporting and guiding means for cast strands, in particular slabs cast in a bow-type continuous casting plant, of the type including a plurality of exchangeable supporting elements, one of said supporting elements being a circular-arc-shaped element and another of said supporting elements being a straightening element located next to said circular-arc-shaped element, said supporting elements being each provided with rollers at opposite sides thereof, the improvement which is characterized in that neighbouring supporting elements are provided with shoulder-like projections where they are separated from each other, said shoulder-like projections being oppositely arranged and backing each other, one roller being mounted on each of said shoulder-like projections so as to complement each other and to form a pair of oppositely arranged rollers, one of said shoulder-like projections with a roller mounted thereon being provided on said circular-arc-shaped element and the oppositely arranged shoulder-like projection with the oppositely arranged roller mounted thereon being provided on said straightening element.

2. A supporting and guiding means as set forth in claim 1, wherein said straightening element is installable and removable in approximately vertical direction, said shoulder-like projection being provided at at least one end of said straightening element at the upper side thereof.

3. A supporting and guiding means as set forth in claim 2, wherein said shoulder-like projection is provided at both ends of said straightening element at the upper side therof.

4. In a supporting and guiding means for cast strands, in particular slabs cast in a bow-type continuous casting plant, of the type including a plurality of exchangeable supporting elements, a first one of said supporting elements being a circular-arc-shaped element, a second one of said supporting elements being a straightening element, and a third one of said supporting elments being a driving element located intermediate said first and second supporting elements, said supporting elements being each provided with rollers at opposite sides thereof, the improvement which is characterized in that the neighbouring supporting elements are provided with shoulder-like projections where they are separated from each other, said shoulder-like projections being oppositely arranged and backing each other, one roller being mounted on each of said shoulder-like projections so as to complement each other and to form a pair of oppositely arranged rollers, one each of said shoulder-like projections with a roller mounted thereon being provided on said circular-arc-shaped element and on said driving element, and one each of the oppositely arranged shoulder-like projection with the oppositely arranged roller mounted thereon being provided on said driving element and on said straightening element.

* * * * *